US007377018B2

(12) United States Patent
Taylor

(10) Patent No.: US 7,377,018 B2
(45) Date of Patent: May 27, 2008

(54) METHOD OF REPLACING A SUBPAD OF A POLISHING APPARATUS

(75) Inventor: Theodore M. Taylor, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 273 days.

(21) Appl. No.: 10/310,721

(22) Filed: Dec. 4, 2002

(65) Prior Publication Data

US 2003/0110609 A1 Jun. 19, 2003

Related U.S. Application Data

(62) Division of application No. 09/652,878, filed on Aug. 31, 2000, now Pat. No. 7,077,733.

(51) Int. Cl.
*B23P 6/00* (2006.01)

(52) U.S. Cl. ..... 29/402.01; 29/402.03; 29/426.1; 451/490; 451/533; 451/538

(58) Field of Classification Search ..... 29/402.01, 29/402.03, 402.08, 426.1, 426.3, 407.09, 29/407.1, 428, 521, 559, 743; 269/21, 289 R; 451/296, 303, 340, 490, 533, 534, 538
See application file for complete search history.

(56) References Cited

U.S. PATENT DOCUMENTS 3,813,825 A * 6/1974 Weber et al. ..... 451/283
5,593,344 A 1/1997 Weldon et al.
5,704,827 A 1/1998 Nishi et al.
5,722,877 A 3/1998 Meyer et al.
5,810,964 A 9/1998 Shiraishi
5,871,390 A 2/1999 Pant et al.
5,921,852 A 7/1999 Kimura et al.
5,931,724 A * 8/1999 Perlov et al. ..... 451/285
5,980,368 A 11/1999 Chang et al.
6,033,293 A 3/2000 Crevasse et al.
6,059,643 A 5/2000 Hu et al.
6,083,083 A 7/2000 Nishimura
6,126,527 A 10/2000 Kao et al.
6,135,859 A * 10/2000 Tietz ..... 451/41
6,220,942 B1 * 4/2001 Tolles et al. ..... 451/65
6,224,474 B1 5/2001 Vander Voort
6,244,944 B1 * 6/2001 Elledge ..... 451/296
6,273,800 B1 8/2001 Walker et al.

(Continued)

*Primary Examiner*—Jermie E. Cozart
(74) *Attorney, Agent, or Firm*—TraskBritt

(57) ABSTRACT

A subpad support for use in a web format or belt format polishing apparatus for polishing one or more layers of semiconductor device structures. The subpad support includes a subpad retention element for nonadhesively securing the subpad thereto. The subpad support may also include one or more lips protruding therefrom so as to at least substantially inhibit lateral movement of the subpad relative to the subpad support. Polishing apparatus including the subpad support are also disclosed. The polishing pads of such polishing apparatus may be at least partially moved away from the subpad or subpad support so as to facilitate assembly of a subpad with the subpad support or removal of the subpad from the subpad support without damaging the polishing pad. Methods of removably securing a subpad to the subpad support, removing the subpad from the subpad support, and replacing another subpad on the subpad support, as well as polishing methods, are also disclosed.

22 Claims, 6 Drawing Sheets

U.S. PATENT DOCUMENTS 6,296,557 B1 10/2001 Walker et al.
6,331,139 B2 12/2001 Walker et al.
6,394,887 B1 5/2002 Edinger
6,439,967 B2 * 8/2002 Carpenter ..... 451/41
6,602,380 B1 8/2003 Doan et al.

* cited by examiner

METHOD OF REPLACING A SUBPAD OF A POLISHING APPARATUS

CROSS-REFERENCE TO RELATED APPLICATION

This application is a divisional of application Ser. No. 09/652,878, filed Aug. 31, 2000, now U.S. Pat. No. 7,077,733, issued Jul. 18, 2006.

BACKGROUND OF THE INVENTION

1. Field of the Invention

The present invention relates to subpad supports in web format and belt format polishing apparatus. Particularly, the present invention relates to subpad supports including non-adhesive subpad securing elements and to polishing apparatus including the subpad supports. The present invention also relates to assemblies including a subpad and a subpad support of the present invention, as well as to methods of assembling a subpad with, securing a subpad to, removing a subpad from, and replacing a subpad on a subpad support of the present invention.

2. State of the Art

Web format polishing apparatus typically include a wafer support and a polishing pad. The wafer support is typically configured to hold a semiconductor wafer, to bring the wafer into contact with the polishing pad, and to rotate the wafer while the wafer is in contact with the polishing pad so as to create friction between the wafer and the polishing pad and, thereby, effect polishing of one or more layers on the wafer. As used herein, the term "polishing" encompasses removal of material from a semiconductor wafer. "Polishing," as used herein, need not achieve a certain surface finish or planarity. A subpad, located on the opposite side of the polishing pad from the wafer support, is configured to prevent the formation of defects on a wafer secured to the wafer support during polishing thereof, as well as to cushion the polishing pad and wafer being polished so as to prevent damage to the wafer during polishing. The subpad is held in place by a subpad support and, conventionally, has been secured to the subpad supports by way of an adhesive material.

Fresh portions of a web format, film-type polishing pad are supplied by a supply reel of the web format polishing apparatus, while used portions of the web format polishing pad are taken up on a take-up reel of the apparatus. Typically, the positions of supply reels and take-up reels on conventional web format polishing apparatus are fixed relative to the remainder of these apparatus.

As a subpad wears, it must be replaced. Typically, in order to remove a subpad from a web format polishing apparatus, the web format polishing pad must either be cut or slack formed in the polishing pad by, for example, loosening the web format pad from the supply reel of the polishing apparatus without winding the pad around the take-up reel. Creating slack in a web format polishing pad facilitates pulling of the polishing pad away from the subpad. When a web format polishing pad is cut or given slack, it is common that a portion of the polishing pad is damaged and, thus, that portion of the polishing pad is wasted. In addition, as the subpad is typically secured to the subpad support with an adhesive material, removal of the subpad from the subpad support is often very difficult since the subpad may rip or need to be scraped from the subpad support.

Belt format polishing apparatus are very similar to web format polishing apparatus, with the major exception being that the polishing pad is in the format of a continuous belt that may be recycled, rather than a web that is supplied from a supply reel and, after use, taken away on a take-up reel. In order to gain access to a subpad of a belt format polishing apparatus, the belt format polishing pad is removed from the polishing apparatus, which is time consuming and may result in damage to the pad, or the pad may be stretched, which may also damage the pad. Damage that may occur to a belt format polishing pad as a subpad is removed and replaced is, however, even more costly than similar damage to a web format polishing pad because a damaged belt format polishing pad must be completely replaced.

The inventor is not aware of a subpad support to which a subpad may be nonadhesively secured and from which a subpad may be readily removed. Moreover, the inventor is not aware of a web format or belt format polishing apparatus configured to facilitate subpad removal and replacement without a significant potential for damaging the polishing pad.

BRIEF SUMMARY OF THE INVENTION

The present invention includes a subpad support with a retention element for removably, nonadhesively securing a subpad thereto, as well as web format and belt format polishing apparatus including the subpad support.

The subpad support of the present invention includes a subpad supporting surface and a subpad retention element. The subpad supporting surface is configured to receive a backing of a subpad. The subpad retention element is configured to nonadhesively secure a subpad to the subpad support. The subpad retention element may be configured to at least partially engage a periphery of a subpad, mechanically engage a backing of a subpad, apply a negative pressure to a backing of a subpad through the subpad support, or otherwise nonadhesively secure a subpad to the subpad support.

The subpad support may also include one or more lips, columns, or other lateral confinement structures protruding from the supporting surface thereof and that are configured and located so as to at least partially prevent lateral movement of a subpad relative to the subpad support to which the subpad is secured.

To facilitate the releasable securing of a subpad to the subpad support, the subpad may include a substantially rigid structure on the backing thereof. The substantially rigid structure may be secured to the backing of the subpad or formed by a denser region of the material of the subpad. If the substantially rigid structure is secured to the backing of the subpad, a material such as a polymer, a metal, a glass, or a ceramic may be used as the substantially rigid structure.

Polishing apparatus including the subpad of the present invention are also within the scope of the present invention. A polishing apparatus incorporating teachings of the present invention may include a component that at least partially moves the polishing pad of the apparatus away from the subpad support thereof, as well as a subpad secured to the subpad support. In a web format polishing apparatus, such a component may include, by way of example only and not to limit the scope of the present invention, a releasable latch that secures one or both of the supply reel and the take-up reel to the remainder of the polishing apparatus. In addition, such an exemplary polishing apparatus may also include a member that effects the controlled movement of one or both of the supply and take-up reels and, thus, the polishing pad away from the remainder of the polishing apparatus. Exemplary members include, but are not limited to, one or more hydraulic pistons, gear drive mechanisms, and screw drive mechanisms.

Methods of assembling and securing a subpad to the subpad support, removing a subpad from the subpad support, and replacing a subpad on the subpad support are also within the scope of the present invention, as are methods of at least partially moving a polishing pad away from a subpad support so as to facilitate such assembly, securing, removal, and replacing.

Other features and advantages of the present invention will become apparent to those of skill in the art through consideration of the ensuing description, the accompanying drawings, and the appended claims.

DETAILED DESCRIPTION OF THE INVENTION

Figure 1:
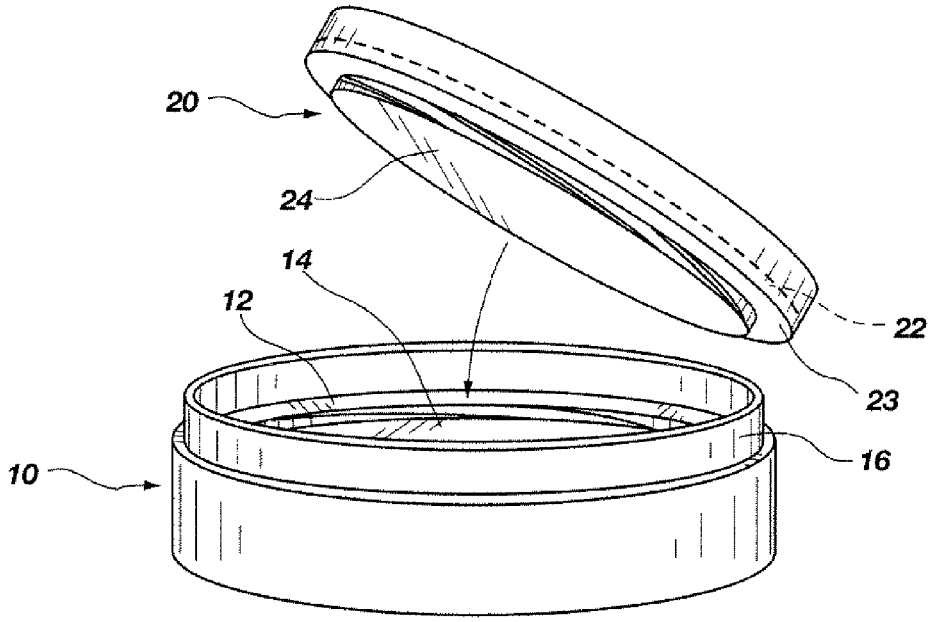
FIG. 1 is a perspective assembly view illustrating an exemplary embodiment of a subpad support incorporating teachings of the present invention and a subpad configured to be secured to the subpad support by way of complementary threads on the subpad and the subpad support.

Referring to FIG. 1, a first exemplary embodiment of a subpad support 10 incorporating teachings of the present invention is illustrated. Subpad support 10 includes a supporting surface 12 and a retention element 14. Supporting surface 12 is configured to engage a backing 22 of a subpad 20. Retention element 14 is configured to secure subpad 20 to subpad support 10. Subpad support 10 may also include one or more lips 16 protruding therefrom and positioned so as to facilitate the alignment of subpad 20 with subpad support 10 during assembly thereof or to at least partially prevent lateral movement of subpad 20 relative to supporting surface 12 during use.

Retention element 14, as illustrated, is configured to mechanically engage a corresponding, complementary structure of a known type, such as the illustrated threaded locking element 24, on backing 22 of subpad 20. Upon interconnecting retention element 14 and locking element 24 and rotating locking element 24 relative to retention element 14, retention element 14 and locking element 24 interlock so as to secure subpad 20 to subpad support 10.

As illustrated, locking element 24 is secured to a backing 22 of subpad 20 by known means, such as with a suitable adhesive. Alternatively, locking element 24 may be integral with backing 22. Backing 22 may be formed from a relatively denser region of the same material as the remainder of subpad 20, which may be formed from a material such as closed-cell polyurethane foam, and may be integral therewith, or may comprise a separate element secured to the remainder, or contact surface 23, of subpad 20. Alternatively, backing 22 may be formed from another polymer (e.g., polycarbonate), a metal, a ceramic, or any other suitable material, different from the material of contact surface 23, which cushions a wafer during polishing thereof. A backing 22 that is separate from the remainder of subpad 20 may be secured thereto as known in the art, such as by use of adhesives or by thermally bonding contact surface 23 of subpad 20 to backing 22 thereof.

Figure 2:
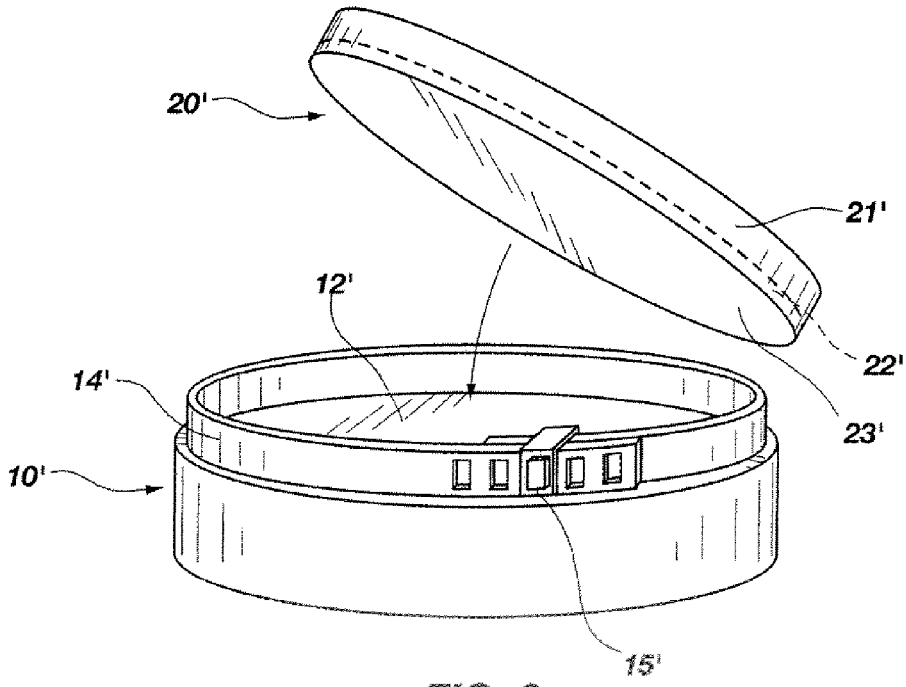
FIG. 2 is a perspective view of another exemplary embodiment of an assembly of a subpad support that includes a clamping member configured to engage at least a portion of a periphery of a subpad.

Turning now to FIG. 2, another embodiment of a subpad support 10' according to the present invention is illustrated. Subpad support 10' includes a supporting surface 12' and a retention element 14'. Again, supporting surface 12' is configured to engage a backing 22' of a subpad 20' to be assembled with subpad support 10'. In addition, retention element 14' is configured to mechanically secure a subpad 20' to subpad support 10'.

Retention element 14' of subpad support 10' includes a clamping member 15' that is configured to be positioned around the periphery 21' of at least a rigid backing 22' of subpad 20' upon assembly of subpad 20' with subpad support 10' and to be biased against periphery 21' so as to secure backing 22' against supporting surface 12' while substantially maintaining the planarity of contact surface 23' of subpad 20' and, thus, the planarity of an area of a polishing pad to be supported by subpad 20'. In addition, clamping member 15' at least partially prevents lateral movement of subpad 20' relative to supporting surface 12'.

Again, subpad 20' includes a cushioning contact surface 23' and a substantially rigid backing 22'. Backing 22' may be formed from a dense region of the same material as contact surface 23' or from another material, such as another polymer, a metal, a ceramic, or another suitable material. If backing 22' is formed from the same material as contact surface 23', backing 22' may be integral with contact surface 23' or a separate element that is secured to contact surface 23'. Of course, if another material is used to form backing 22', backing 22' is secured to contact surface 23'. Backing 22' and contact surface 23' of subpad 20' may be secured to one another by known means, such as by use of a suitable adhesive material or by thermally bonding backing 22' and contact surface 23' to one another.

Figure 3:
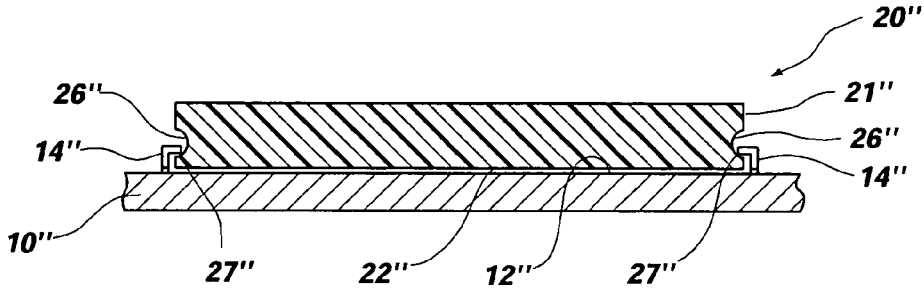
FIG. 3 is a cross-sectional representation of an embodiment of a subpad support-subpad assembly wherein the subpad support includes clamping members configured to engage recessed portions of a complementary subpad.

Another embodiment of subpad support 10" is shown in FIG. 3. Subpad support 10" includes a supporting surface 12" that is configured to engage a backing 22" of a subpad 20". Subpad support 10" also includes retention elements 14" that are configured to clamp onto corresponding receptacles 26" recessed in periphery 21" of subpad 20". Each receptacle 26", along with backing 22", forms a lip 27", which a corresponding retention element 14" engages upon being disposed in a clamping position. Upon engaging lips 27" with retention elements 14", backing 22" of subpad 20" is held against supporting surface 12" of subpad support 10".

Figure 4:
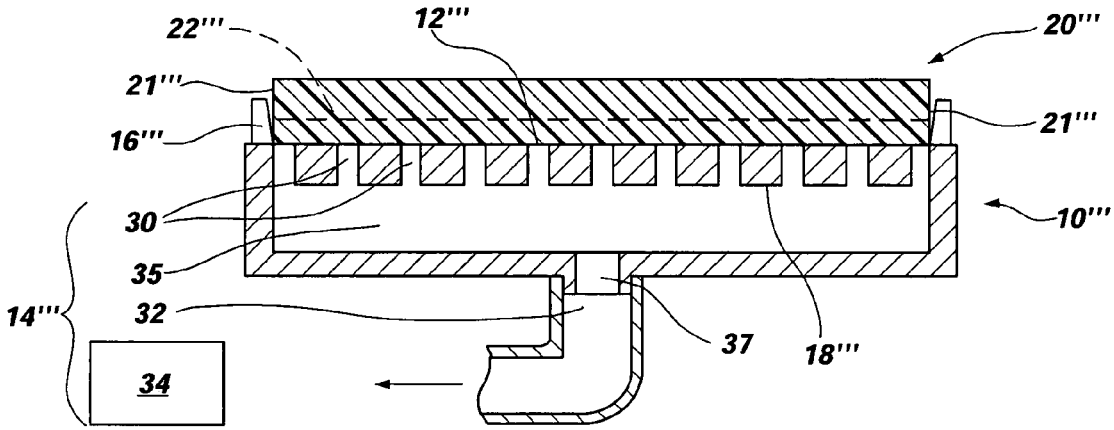
FIG. 4 is a cross-sectional representation of yet another exemplary embodiment of an assembly including a subpad support and a subpad of the present invention, wherein the subpad support is configured to apply a relatively negative pressure to the backside of the subpad to secure the subpad thereto.

FIG. 4 illustrates yet another embodiment of a subpad support 10''' incorporating teachings of the prevent intention. As the previously described subpad support embodiments, subpad support 10''' includes a supporting surface 12''' and a retention element 14'''. Subpad support 10''' may also include one or more columns 16''', lips, or other structures protruding from supporting surface 12'''. Columns 16''' are preferably configured so as to laterally surround a periphery 21''' of subpad 20''' upon assembly thereof with subpad support 10'''. Columns 16''' are configured to align a subpad 20''' with subpad support 10''', to substantially laterally surround a subpad 20''' assembled with subpad support 10''', or to at least substantially inhibit subpad 20''' from moving laterally relative to supporting surface 12'''.

Supporting surface 12''' is configured to engage a backing 22''' of a subpad 20''' upon assembly of subpad 20''' with subpad support 10'''.

Retention element 14''' employs a negative pressure to secure a subpad 20''' to subpad support 10'''. Retention element 14''' includes one or more apertures 30 formed through subpad support 10''' from supporting surface 12''' to an opposite surface 18'''. Apertures 30 communicate with a negative pressure, or vacuum, source 34 by way of a negative pressure conduit 32 between apertures 30 and negative pressure source 34. As illustrated in FIG. 4, retention element 14''' also includes a chamber 35 formed within subpad support 10''' and communicating with each aperture 30. In turn, chamber 35 communicates with conduit 32 by way of a connection port 37 on subpad support 10'''. Alternatively, each aperture 30 of a retention element 14''' incorporating teachings of the present invention may communicate with negative pressure source 34 by way of separate conduits 32. In any event, retention element 14''' secures a subpad 20''' to supporting surface 12''' of subpad support 10''' by applying a negative pressure to backing 22''' of subpad 20''' through apertures 30 formed in subpad support 10'''.

Figure 5:
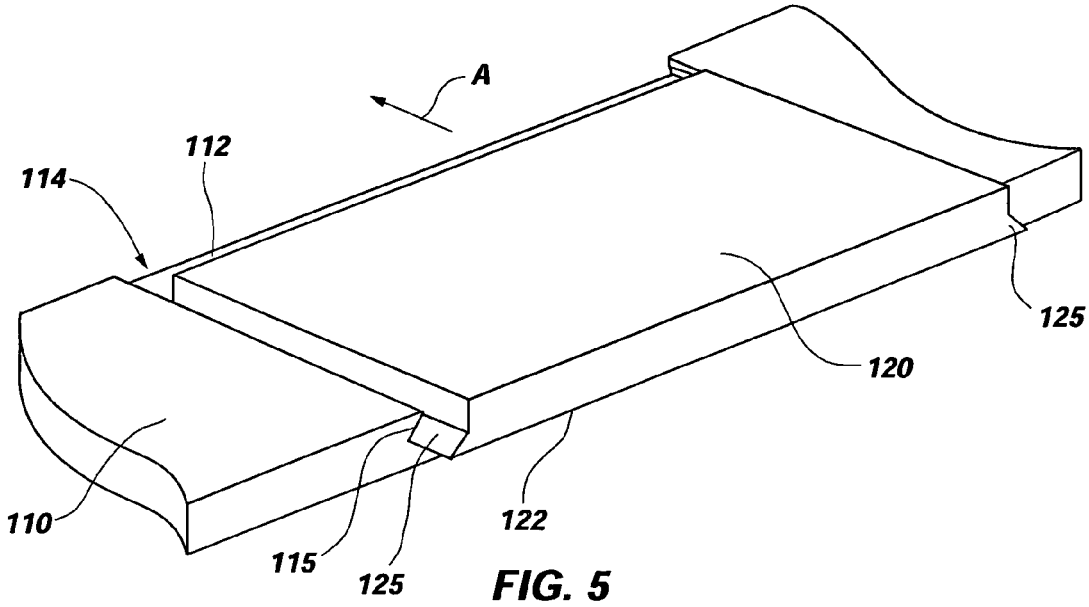
FIG. 5 is a partial perspective view of an embodiment of a subpad support configured to slidingly engage a complementarily configured subpad.

With reference to FIG. 5, a subpad support 110 configured to receive a rectangular subpad 120 is illustrated. Subpad support 110 includes a recessed retention element 114 that is continuous with at least one end of subpad support 110. Retention element 114 includes elongated retention slots 115 at opposite sides thereof. Retention slots 115 are configured to engage corresponding, opposite ends of a complementarily configured subpad 120 upon sliding subpad 120 in the direction of arrow A to position backing 122 of subpad 120 in substantial contact with supporting surface 112 of subpad support 110 and to effect engagement of subpad 120 by retention element 114. Accordingly, retention slots 115 may extend laterally beneath a supporting surface 112 of subpad support 110 so as to engage thin or tapered edges 125 of subpad 120.

Figure 6:
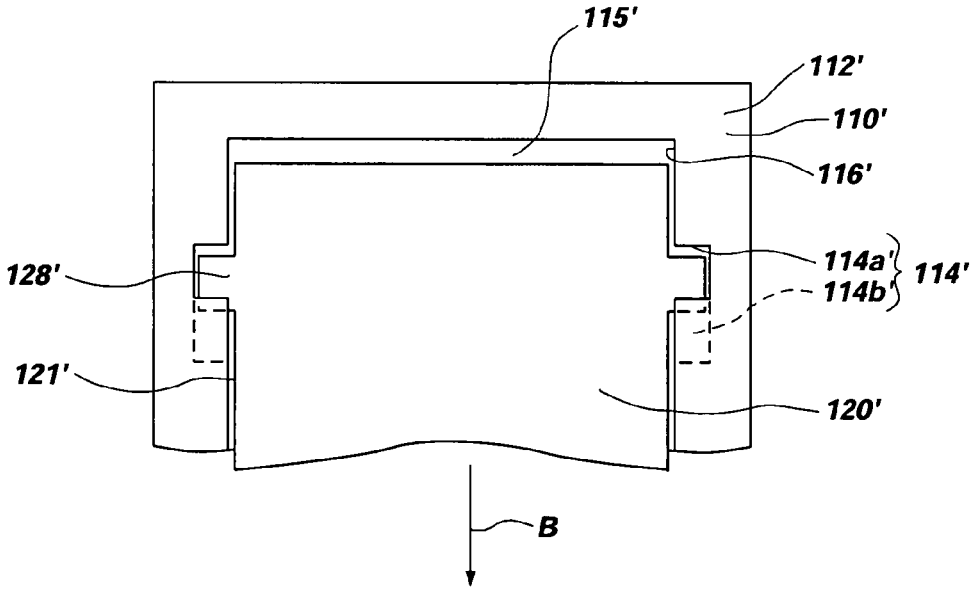
FIG. 6 is a partial top view of an embodiment of subpad support with recesses and slots configured to receive tabs protruding from the periphery of a complementarily configured subpad.

As shown in FIG. 6, a subpad support 110' incorporating teachings of the present invention may include a subpad receptacle 115' formed in a supporting surface 112' of subpad support 110' and configured to receive at least a backing (not shown) of a complementarily configured subpad 120'. In the illustrated embodiment of subpad support 110', retention elements 114' are disposed around the periphery 116' of receptacle 115' and include recesses 114*a*' and slots 114*b*' that are continuous with receptacle 115'. Recesses 114*a*' are formed in supporting surface 112' and, upon introduction of the backing of subpad 120' into receptacle 115', are configured to receive tabs 128' that protrude laterally from periphery 121' of subpad 120', in a plane substantially parallel to the plane of subpad 120', and are located proximate the backing of subpad 120'. Retention elements 114' also include slots 114*b*' that are continuous with recesses 114*a*' and that underlie supporting surface 112'. Upon sliding of subpad 120' in the direction of arrow B relative to subpad support 110', retention tabs 128' are positioned within slots 114*b*' and subpad 120' is engaged by subpad support 110'.

Figure 7A:
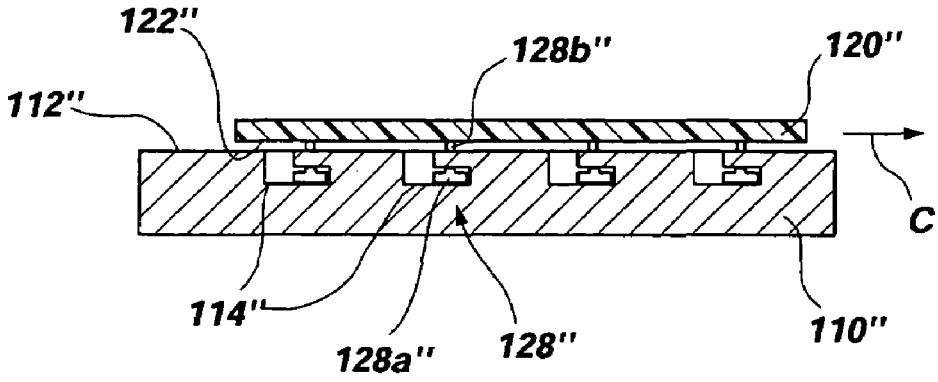
FIGS. 7A and 7B illustrate still another embodiment of subpad support and subpad incorporating teachings of the present invention, wherein the subpad support includes keyhole-shaped recesses configured to receive headed studs protruding from the backing of the subpad.
Figure 7B:
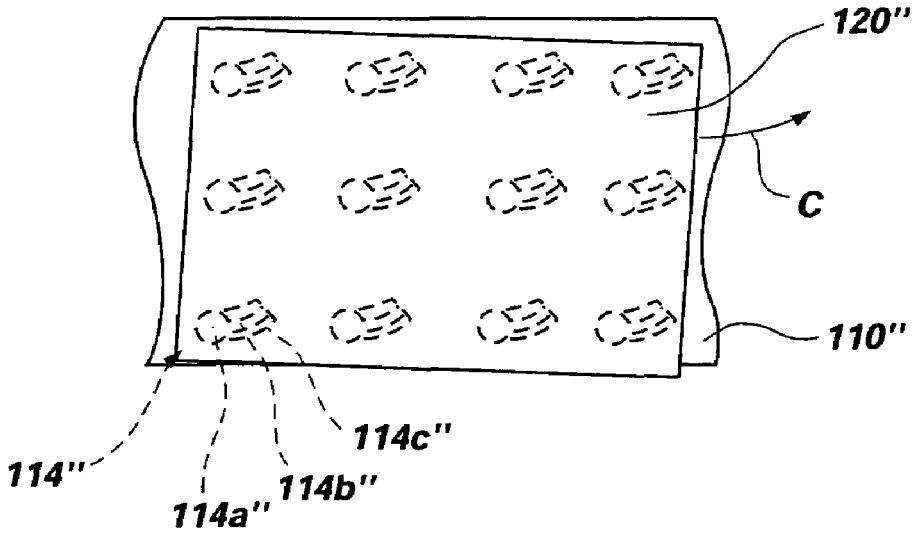

Another embodiment of subpad support 110" and complementary subpad 120" incorporating teachings of the present invention is illustrated in FIGS. 7A and 7B. Subpad support 110" includes a supporting surface 112" with a series of keyhole-shaped retention elements 114" formed therein. Retention elements 114" include an enlarged end 114*a*" and a narrower, elongated slot 114*b*" formed through and continuous with supporting surface 112", as well as a receptacle 114*c*" underlying supporting surface 112", enlarged end 114*a*", and elongated slot 114*b*". Enlarged end 114*a*" of each retention element 114" is configured to receive a head 128*a*" of a corresponding retention stud 128" that protrudes from a backing 122" of subpad 120". Slot 114*b*" is narrower than end 114*a*" and is configured to receive a neck 128*b*" of retention stud 128" as head 128*a*" is positioned within the portion of receptacle 114*c*" that underlies slot 114*b*". As shown in FIGS. 7A and 7B, retention elements 114", including slot 114*b*" and receptacle 114*c*" thereof, may be slightly curved so as to facilitate engagement of a subpad 120" by subpad support 110" upon slight rotation of subpad 120" in the direction of arrow C relative to subpad support 110". Alternatively, slot 114*b*" and receptacle 114*c*" of a retention element 114" may be angled so as to facilitate the retention of a complementary retention stud 128" therein.

Figure 8:
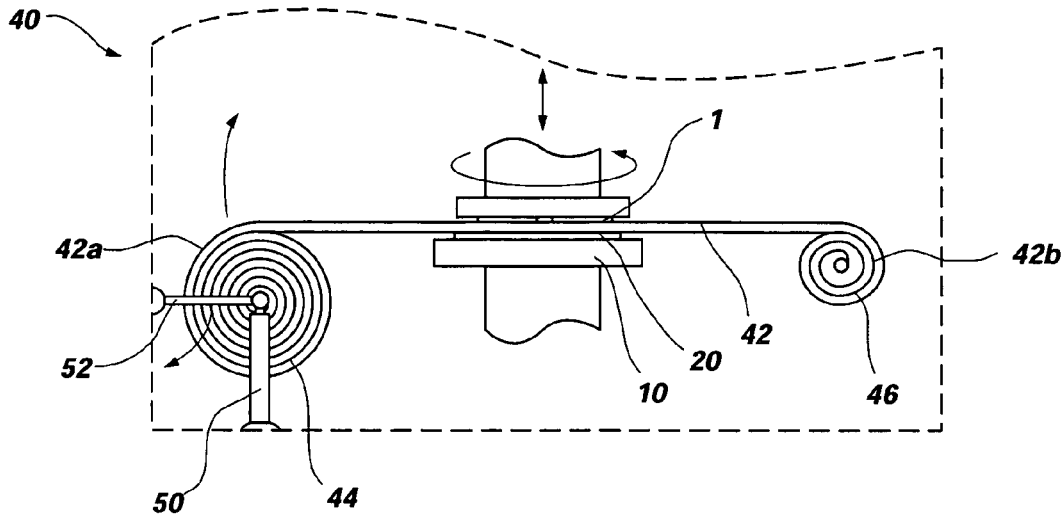
FIGS. 8 and 8A are schematic representations of a belt format polishing apparatus incorporating teachings of the present invention, depicting at least partial movement of the polishing pad thereof away from the subpad support thereof.
Figure 8A:
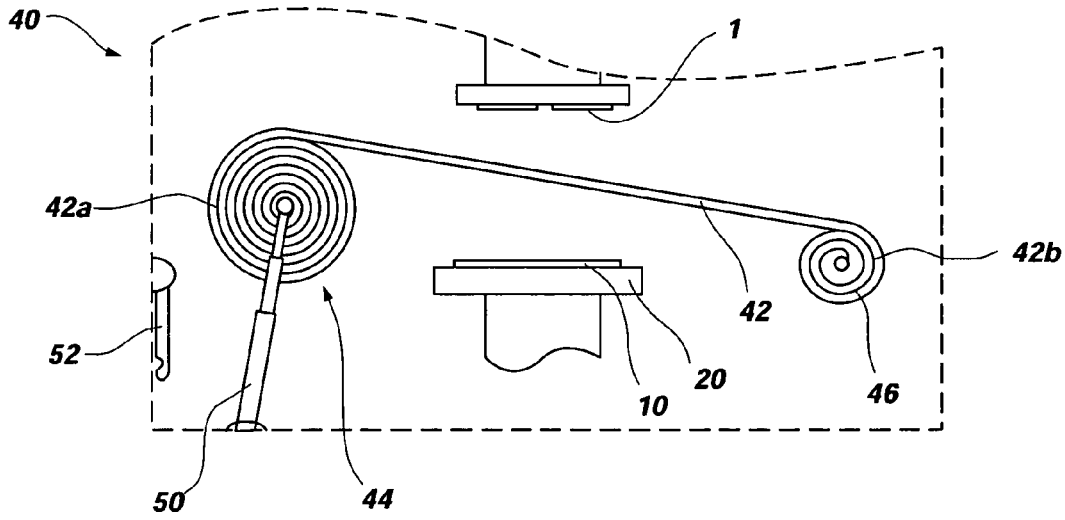
Figure 9:
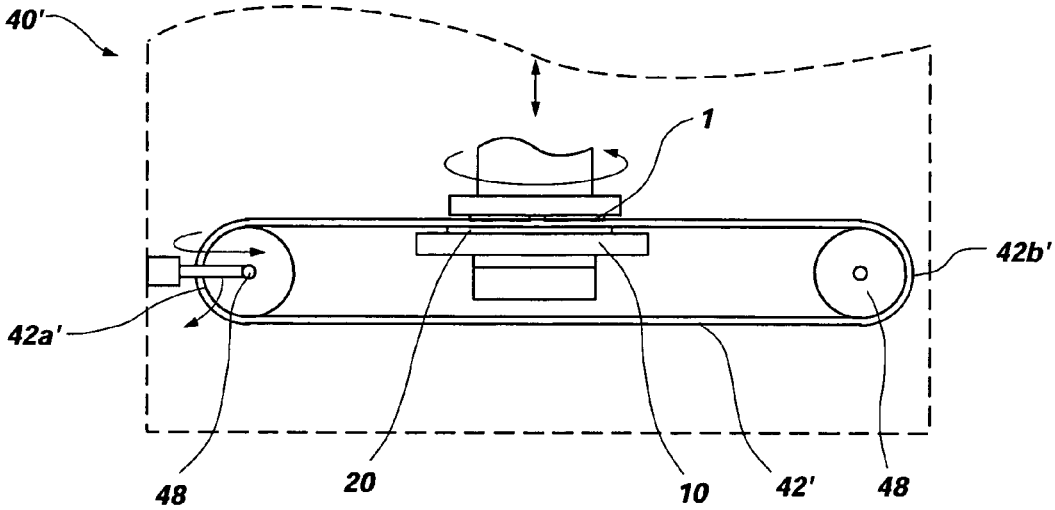
FIGS. 9 and 9A are schematic representations of a belt format polishing apparatus incorporating teachings of the present invention, depicting movement of the polishing pad thereof away from the subpad support thereof.
Figure 9A:
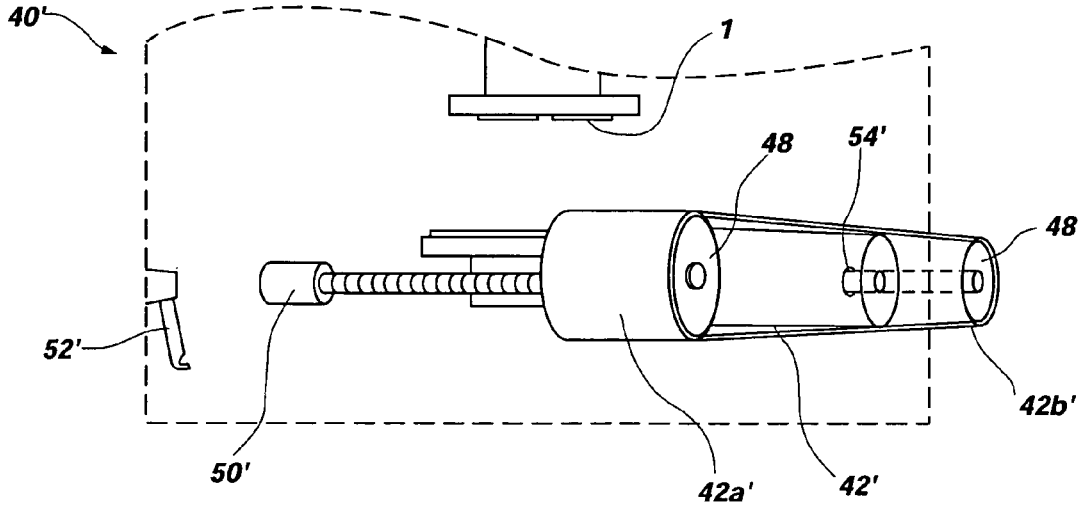

Referring now to FIGS. 8, 8A, 9, and 9A, subpad support 10 may be included in a web format polishing apparatus 40, illustrated in FIGS. 8 and 8A, or in a belt-type polishing apparatus 40', shown in FIGS. 9 and 9A.

As shown in FIG. 8, subpad support 10 of polishing apparatus 40 is positioned adjacent a web format polishing pad, which is referred to herein and known in the art as a "web" 42. Polishing apparatus 40 also includes a supply reel 44 from which fresh portions of web 42 are supplied, as well as a take-up reel 46, which receives previously used portions of web 42. In use of polishing apparatus 40, a semiconductor device structure 1 is brought into frictional contact with web 42, on an opposite side thereof from subpad support 10. As semiconductor device structure 1 is polished at least in part by web 42, the portion of web 42 that is being used to polish semiconductor device structure 1 is supported from beneath by a subpad 20 assembled with subpad support 10.

Web 42 and subpad 20 of polishing apparatus 40 are positioned in close proximity to one another. Polishing apparatus 40 includes a polishing pad movement element 50, which is also referred to herein as a subpad access element, to effect the movement of web 42 at least partially away from subpad 20 so as to avoid physical contact of an operator with web 42 while facilitating access to a worn or damaged subpad 20. As illustrated in FIGS. 8 and 8A, polishing pad movement element 50 is associated with at least one of supply reel 44 and take-up reel 46 of polishing apparatus 40. Polishing pad movement element 50 preferably effects the movement of web 42 away from subpad support 10 in a controlled manner and at a controlled rate to minimize stress on web 42. By way of example, and not to limit the scope of the present invention, known apparatus that may be used as polishing pad movement element 50 include hydraulic pistons, screw drive motors, gear drive motors, and the like. Polishing apparatus 40 may also include a latch 52 or other known releasable locking element that is configured to prevent movement of web 42 away from subpad 20 and subpad support 10 when such movement is not desired. In addition, if polishing pad movement element 50 moves one end 42*a* of web 42 while the other end 42*b* of web 42 remains substantially stationary, end 42*b* may be pivotally connected to apparatus 40, such as by a pivot pin 54' that connects one conveyor support 48 to a fixed structure of apparatus 40 or otherwise, as known in the art (see FIGS. 9 and 9A).

Referring now to FIGS. 9 and 9A, polishing apparatus 40' includes a belt format polishing pad, which is referred to herein and known in the art as a "belt" 42'. Belt 42' may be continually moved around conveyor supports 48 to supply fresh or newly conditioned portions of belt 42' for use in polishing a semiconductor device structure 1. As semiconductor device structure 1 is brought into frictional contact with belt 42' to effect polishing of semiconductor device structure 1, the portion of belt 42' that is being used to polish semiconductor device structure 1 is supported from beneath by a subpad 20 assembled with subpad support 10.

As shown in FIG. 9, belt 42' and subpad 20 are positioned very closely to one another. In order to avoid physical contact by an operator with belt 42' to gain access to a worn or damaged subpad 20 to remove and replace the same on subpad support 10, polishing apparatus 40' is supplied with a polishing pad movement element 50' that effects the movement of belt 42' at least partially away from subpad 20. As illustrated in FIGS. 9 and 9A, polishing pad movement element 50' is associated with at least one conveyor support 48 of polishing apparatus 40'. Polishing pad movement element 50' preferably effects the movement of belt 42' away from subpad support 10 in a controlled manner and at a controlled rate. Examples of known apparatus that are useful as polishing pad movement element 50' include hydraulic cylinders, pneumatic cylinders, screw drive motors, gear drive motors, and the like. Polishing apparatus 40' may also include a latch 52' configured to prevent movement of belt 42' away from subpad 20 and subpad support 10 when such movement is not desired. In addition, if polishing pad movement element 50' moves one end 42*a'* of belt 42' while the other end 42*b'* of belt 42' remains substantially stationary, end 42*b'* may be pivotally connected to apparatus 40', such as by a pivot pin 54' that connects one conveyor support 48 to a fixed structure of apparatus 40' or otherwise, as known in the art.

An example of the manner in which a subpad 20 is removed from subpad support 10 of polishing apparatus 40' and replaced on subpad support 10 is described with continued reference to FIGS. 9 and 9A. Latch 52' of polishing apparatus 40' is positioned so as to facilitate the movement of end 42*a'* of belt 42' while end 42*b'* of belt 42' pivots around pivot pin 54', thereby at least partially moving belt 42' away from subpad 20 and subpad support 10 so as to facilitate access to subpad 20. Belt 42' is then at least partially moved away from subpad 20 and subpad support 10 with the assistance of or by way of polishing pad movement element 50'. Of course, apparatus 40' could be configured such that both ends 42*a'*, 42*b'* of belt 42' may be moved so as to effect movement of belt 42' away from subpad support 10. Next, subpad 20 is released by retention element 14 (see, e.g., FIGS. 1-3) and disassembled from subpad support 10. Another subpad 20 may be assembled with subpad support 10 and secured thereto by retention element 14. Belt 42' may then be repositioned adjacent subpad 20 and subpad support 10 with the assistance or by way of polishing pad movement element 50'. Latch 52' may be repositioned so as to secure belt 42' in place.

Although the foregoing description contains many specifics, these should not be construed as limiting the scope of the present invention, but merely as providing illustrations of some of the presently preferred embodiments. Similarly, other embodiments of the invention may be devised which do not depart from the spirit or scope of the present invention. Features from different embodiments may be employed in combination. The scope of the invention is, therefore, indicated and limited only by the appended claims and their legal equivalents, rather than by the foregoing description. All additions, deletions and modifications to the invention as disclosed herein which fall within the meaning and scope of the claims are to be embraced thereby.

What is claimed is:

1. A method for replacing a subpad of an apparatus for polishing one or more layers of a semiconductor device structure, comprising:

obtaining access to a subpad that cushions a polishing pad during polishing;

disengaging a nonadhesive subpad retention element of a subpad support of the apparatus from the subpad; and disassembling the subpad from the subpad support.

2. The method of claim 1, wherein obtaining access comprises moving at least one of a polishing pad of the apparatus and the subpad from a polishing position to a subpad replacement position.

3. The method of claim 2, wherein moving comprises moving a polishing pad support of the apparatus so as to reposition the polishing pad at least partially away from the subpad.

4. The method of claim 1, wherein obtaining access comprises moving at least one of a polishing pad of the apparatus and the subpad at least partially away from the other of the polishing pad and the subpad.

5. The method of claim 4, wherein moving comprises moving a polishing pad support of the apparatus so as to reposition the polishing pad at least partially away from the subpad.

6. The method of claim 1, further comprising:

removing, from a backing of the subpad, a negative pressure applied to the backing of the subpad through the subpad support.

7. The method of claim 1, further comprising:

assembling another subpad with the subpad support.

8. The method of claim 7, further comprising:

assembling the another subpad to the subpad support and engaging the another subpad with the nonadhesive subpad retention element.

9. The method of claim 8, further comprising:

repositioning a polishing pad adjacent to the another subpad.

10. The method of claim 1, wherein disengaging comprises mechanically disengaging.

11. The method of claim 10, wherein mechanically disengaging comprises mechanically disengaging a backing of the subpad.

12. The method of claim 10, further comprising:

disengaging a nonadhesive subpad retention element from at least a portion of a peripheral edge of the subpad.

13. A method for replacing a subpad of an apparatus for polishing one or more layers of a semiconductor device structure, comprising:

obtaining access to a subpad that cushions a polishing pad during polishing;

removing, from a backing of a subpad, a negative pressure applied to the backing of the subpad through a subpad that cushions a polishing pad during polishing;

disassembling the subpad from the subpad support.

14. The method of claim 13, wherein obtaining access comprises moving at least one of a polishing pad of the apparatus and the subpad from a polishing position to a subpad replacement position.

15. The method of claim 14, wherein moving comprises moving a polishing pad support of the apparatus so as to reposition the polishing pad at least partially away from the subpad.

16. The method of claim 13, wherein obtaining access comprises moving at least one of a polishing pad of the apparatus and the subpad at least partially away from the other of the polishing pad and the subpad.

17. The method of claim 16, wherein moving comprises moving a polishing pad support of the apparatus so as to reposition the polishing pad at least partially away from the subpad.

18. The method of claim 13, further comprising:

mechanically disengaging a nonadhesive subpad retention element from a backing of the subpad.

19. The method of claim 13, further comprising:

disengaging a nonadhesive subpad retention element from at least a portion of a peripheral edge of the subpad.

20. The method of claim 13, further comprising:

assembling another subpad with the subpad support.

21. The method of claim 20, further comprising:

assembling the another subpad to the subpad support and securing the another subpad to the subpad support.

22. The method of claim 21, further comprising:

repositioning a polishing pad adjacent to the another subpad.

* * * * *

UNITED STATES PATENT AND TRADEMARK OFFICE

CERTIFICATE OF CORRECTION

PATENT NO. : 7,377,018 B2
APPLICATION NO. : 10/310721
DATED : May 27, 2008
INVENTOR(S) : Taylor It is certified that error appears in the above-identified patent and that said Letters Patent is hereby corrected as shown below:

In column 9, line 8, in Claim 13, delete "that cushions a polishing pad during polishing;" and insert -- support; and --, therefor.

Signed and Sealed this

Nineteenth Day of August, 2008

JON W. DUDAS
*Director of the United States Patent and Trademark Office*